US007544850B2

(12) United States Patent
Goze et al.

(10) Patent No.: US 7,544,850 B2
(45) Date of Patent: Jun. 9, 2009

(54) LOW VISCOSITY PAO BASED ON 1-TETRADECENE

(75) Inventors: Maria Caridad Brillantes Goze, East Brunswick, NJ (US); Pramod Jayant Nandapurkar, Plainsboro, NJ (US); Norman Yang, Westfield, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 246 days.

(21) Appl. No.: 11/388,347

(22) Filed: Mar. 24, 2006

(65) Prior Publication Data

US 2007/0225534 A1 Sep. 27, 2007

(51) Int. Cl.
*C07C 2/08* (2006.01)

(52) U.S. Cl. ..... 585/525; 585/520; 585/521

(58) Field of Classification Search ..... 585/520, 585/521, 525

See application file for complete search history.

(56) References Cited

U.S. PATENT DOCUMENTS

| | | | | |
|---|---|---|---|---|
| 3,149,178 | A | 9/1964 | Hamilton et al. | 260/683.9 |
| 3,382,291 | A | 5/1968 | Brennan | 260/683.15 |
| 3,742,082 | A | 6/1973 | Brennan | 260/683.9 |
| 3,780,128 | A | 12/1973 | Shubkin | 260/683.9 |
| 4,045,507 | A | 8/1977 | Cupples et al. | 260/683.15 |
| 4,172,855 | A | 10/1979 | Shubkin et al. | 585/16 |
| 4,533,782 | A | 8/1985 | Merijanian | 585/520 |
| 4,956,122 | A | 9/1990 | Watts et al. | 252/565 |
| 5,196,635 | A | 3/1993 | Kumar et al. | 585/532 |
| 5,284,988 | A * | 2/1994 | Schaerl et al. | 585/525 |
| 5,693,598 | A | 12/1997 | Abraham et al. | 508/444 |
| 6,071,863 | A | 6/2000 | Benda et al. | 508/591 |
| 6,303,548 | B2 | 10/2001 | Gao | 508/469 |
| 6,313,077 | B1 | 11/2001 | Stunnenberg et al. | 508/591 |
| 6,395,948 | B1 | 5/2002 | Hope et al. | 585/510 |
| 6,646,174 | B2 | 11/2003 | Clarembeau | 585/525 |
| 6,686,511 | B2 | 2/2004 | Miller et al. | 585/519 |
| 6,706,828 | B2 | 3/2004 | DiMaio | 526/160 |
| 6,713,582 | B2 | 3/2004 | DiMaio et al. | 526/281 |
| 6,824,671 | B2 | 11/2004 | Goze et al. | 208/19 |
| 6,869,917 | B2 | 3/2005 | Deckman et al. | 508/110 |
| 6,949,688 | B2 | 9/2005 | Goze et al. | 585/525 |
| 2002/0128532 | A1 | 9/2002 | Hope et al. | 585/521 |
| 2002/0137636 | A1 | 9/2002 | Hartley et al. | 508/110 |
| 2003/0119682 | A1 | 6/2003 | Saini et al. | 508/167 |
| 2003/0166986 | A1 | 9/2003 | Clarembeau | 585/525 |
| 2004/0030075 | A1 | 2/2004 | Hope et al. | 526/237 |
| 2004/0033908 | A1 | 2/2004 | Deckman et al. | 508/110 |
| 2004/0129603 | A1 | 7/2004 | Fyfe et al. | 208/18 |
| 2004/0154957 | A1 | 8/2004 | Keeney et al. | 208/18 |
| 2004/0154958 | A1 | 8/2004 | Alexander et al. | 208/18 |
| 2006/0211904 | A1 | 9/2006 | Goze et al. | 585/520 |

FOREIGN PATENT DOCUMENTS

| | | |
|---|---|---|
| JP | 01095108 | 4/1989 |
| RU | 2212936 | 9/2003 |
| WO | WO 90/13620 | 11/1990 |
| WO | WO 99/38938 | 8/1999 |
| WO | WO 02/092729 | 11/2002 |

OTHER PUBLICATIONS

"Next Generation Polyalphaolefins—The Next Step in the Evolution of Synthetic Hydrocarbon Fluids", Moore et al., Innovene USA LLC Nov. 22, 2005 revision; posted Nov. 22, 2005 at www.innovene.com.

Wills, J.G., "*Synthetic Lubricants*," Lubrication Fundamentals, Marcel Dekker Inc., New York, 1980, pp. 75-80.

* cited by examiner

*Primary Examiner*—In Suk Bullock
(74) *Attorney, Agent, or Firm*—Nancy T. Krawczyk; Andrew B. Griffis; Jennifer A. Schmidt

(57) ABSTRACT

Disclosed herein is a method of making a PAO using tetradecene and particularly mixtures comprising 1-hexene, 1-decene, 1-dodecene, and 1-tetradecene, characterized by a low viscosity and excellent cold temperature properties, using a promoter system comprising an alcohol and an ester. In embodiments, the product has properties similar to those obtainable using a feed of solely 1-decene.

14 Claims, No Drawings

LOW VISCOSITY PAO BASED ON 1-TETRADECENE

FIELD OF THE INVENTION

The invention relates to a method of making a PAO with low viscosity, low Noack volatility, and excellent cold temperature properties, using a promoter system comprising an alcohol and an ester and using a mixture comprising 1-tetradecene.

BACKGROUND OF THE INVENTION

Poly α-olefins (polyalphaolefins or PAO) comprise one class of hydrocarbon lubricants which has achieved importance in the lubricating oil market. These materials are typically produced by the polymerization of α-olefins in the presence of a catalyst such as $AlCl_3$, $BF_3$, or $BF_3$ complexes. Typical α-olefins for the manufacture of PAO range from 1-octene to 1-dodecene. It is known to make polymers using higher olefins, such as 1-tetradecene, as described in WO 99/38938, and lower olefins, such as ethylene and propylene including copolymers of ethylene with higher olefins, as described in U.S. Pat. No. 4,956,122. Oligomerization is typically followed by fractionation and by a step of hydrogenation to remove unsaturated moieties in order to obtain the desired product slate. In the course of hydrogenation, the amount of unsaturation is generally reduced by greater than 90%.

PAOs are commonly categorized by the numbers denoting the approximate viscosity, in centistokes (cSt), of the PAO at 100° C. PAO products may be obtained with a wide range of viscosities varying from highly mobile fluids with a nominal viscosity of about 2 cSt at 100° C. to higher molecular weight, viscous materials which have viscosities exceeding 100 cSt at 100° C. Viscosities as used herein are Kinematic Viscosities determined at 100° C. by ASTM D-445, unless otherwise specified. The term "nominal" as used herein means that the number has been rounded to provide a single significant figure.

PAOs may also be characterized by other important properties, depending on the end use. For instance, a major trend in passenger car engine oil usage is the extension of oil drain intervals. Due to tighter engine oil performance, a need exists for low viscosity PAO products with improved physical properties, e.g., evaporation loss as measured by, for instance, Noack volatility, as well as excellent cold weather performance, as measured by, for instance, pour point or Cold Crank Simulator (CCS) test. Noack volatilities are typically determined according to ASTM D5800; pour points are typically determined according to ASTM D97; and CCS is obtained by ASTM D5293.

PAOs are normally produced via cationic oligomerization of linear alpha olefins (LAOs). Low viscosity PAOs have been produced by $BF_3$-catalyzed oligomerization based on 1-decene for many years. Processes for the production of PAO lubricants have been the subject of numerous patents, such as U.S. Pat. Nos. 3,149,178; 3,382,291; 3,742,082; 3,780,128; 4,045,507; 4,172,855; and more recently U.S. Pat. Nos. 5,693,598; 6,303,548; 6,313,077; U.S. Applications 2002/0137636; 2003/0119682; 2004/0129603; 2004/0154957; and 2004/0154958, in addition to other patent documents cited herein. PAOs are included as the subject of numerous textbooks, such as Lubrication Fundamentals, J. G. Wills, Marcel Dekker Inc., (New York, 1980), and Synthetic Lubricants and High-Performance Functional Fluids, 2nd Ed., Rudnick and Shubkin, Marcel Dekker Inc., (New York, 1999).

The properties of a particular grade of PAO are greatly dependent on the α-olefin used to make that product, as well as the catalyst used and other process details. In general, the higher the carbon number of the α-olefin, the lower the Noack volatility and the higher the pour point of the product. PAO's having a nominal viscosity at 100° C. of 4 cSt are typically made from 1-decene and have a Noack volatility of 13-14% and pour point of <−60° C. PAO's having a nominal viscosity at 100° C. of 6 cSt are typically prepared from 1-decene or a blend of α-olefins and have a Noack volatility of about 7.0% and pour point of about −57° C. PAOs made from LAOs that have molecular weights higher than 1-decene typically have higher pour points but lower viscosities at low temperatures. These effects are generally caused by waxiness of the oligomerized molecules. PAOs made from very low molecular weight LAOs such as 1-hexene, also have high pour point as well as high viscosity at low temperature. These effects could be attributed to the formation of branched molecules coupled with viscosity increases. In the past, when oligomerizing LAO mixtures, mixtures of high and low molecular weight LAOs are generally used in an attempt to offset the properties and arrive at PAOs roughly similar in properties to C10-based oligomers.

U.S. Pat. No. 6,071,863 discloses PAOs made by mixing C12 and C14 alphaolefins and oligomerizing using a $BF_3$-n-butanol catalyst. While the biodegradability of the product was reported to be improved when compared with a commercial lubricant, the pour point was significantly higher.

In U.S. Pat. No. 6,646,174, a mixture of about 10 to 40 wt. % 1-decene and about 60 to 90 wt. % 1-dodecene and are co-oligomerized in the presence of an alcohol promoter. Preferably 1-decene is added portion-wise during the single oligomerization reactor containing 1-dodecene and a pressurized atmosphere of boron trifluoride. Product is taken overhead and the various cuts are hydrogenated to give the PAO characterized by a kinematic viscosity of from about 4 to about 6 at 100° C., a Noack weight loss of from about 4% to about 9%, a viscosity index of from about 130 to about 145, and a pour point in the range of from about −60° C. to about −50° C.

In U.S. Pat. No. 6,824,671. A mixture of about 50 to 80 wt. % 1-decene and about 20 to 50 wt. % 1-dodecene are co-oligomerized in two continuous stirred-tank reactors in series using $BF_3$ with an ethanol:ethyl acetate promoter. Monomers and dimers are taken overhead and the bottoms product is hydrogenated to saturate the trimers and higher oligomers to create a 5 cSt PAO. This product is further distilled and the distillation cuts blended to produce a 4 cSt PAO containing mostly trimers and tetramers, and a 6 cSt PAO containing trimers, tetramers, and pentamers. The lubricants thus obtained are characterized by a Noack volatility of about 4% to 12%, and a pour point of about −40° C. to −65° C. See also U.S. Pat. No. 6,949,688. (Note that, as used in the present specification, "dimer" includes all possible dimer combinations of the feed, e.g., for a feed comprising C10 and C12, "dimers" comprise a mixture of oligomers containing C20, C22, and C24, otherwise referred to as "$C_{20}$ to $C_{24}$ fractions").

U.S. Patent Application 2004/0033908 is directed to fully formulated lubricants comprising PAOs prepared from mixed olefin feed exhibiting superior Noack volatility at low pour points. The PAOs are prepared by a process using an $BF_3$ catalyst in conjunction with a dual promoter comprising alcohol and alkyl acetate, and the products are the result of blending of cuts.

U.S. patent application Ser. No. 11/338,231 describes trimer rich oligomers produced by a process including contacting a feed comprising at least one α-olefin with a catalyst comprising $BF_3$ in the presence of a $BF_3$ promoter comprising an alcohol and an ester formed therefrom, in at least one continuously stirred reactor under oligomerization conditions. Products lighter than trimers are distilled off after polymerization from the final reactor vessel and the bottoms product is hydrogenated. The hydrogenation product is then distilled to yield a trimer-rich product. In preferred embodiments, the feed comprises at least two species selected from 1-octene, 1-decene, 1-dodecene, and 1-tetradecene.

A document entitled "Next Generation Polyalphaolefins—the next step in the evolution of synthetic hydrocarbon fluids", Moore et al., Innovene USA LLC Nov. 22, 2005 revision; posted Nov. 22, 2005 at www.innovene.com (last visited Mar. 1, 2006) discusses PAOs based on C10 PAOs and C12/C14 PAOs.

It is becoming increasing more difficult for the industry to keep up with the demand for lubricating basestocks having properties similar to C10-based PAOs. It would be highly beneficial if the range of linear alphaolefins that could be used to make such basestocks could be extended. The present inventors have surprisingly discovered that under appropriate conditions compositions comprising 1-hexene may be oligomerized to yield useful basestocks having properties, in preferred embodiments, similar to 1-decene-based PAOs.

SUMMARY OF THE INVENTION

The invention concerns a method of making a low viscosity PAO comprising contacting 1-tetradecene, and in a preferred embodiment, a mixture of alphaolefins including 1-hexene, 1-decene, 1-dodecene, and 1-tetradecene, with an alphaolefin oligomerization catalyst and a dual promoter comprising an alcohol and an ester promoter, oligomerizing said mixture and recovering a product. In preferred embodiments said product is characterized by a viscosity at 100° C. of from about 4 to about 12 cSt, or about 4 cSt to about 8 cSt, or about 4 cSt to about 6 cSt.

In embodiments, the reaction may be carried out in semi-batch mode in a single stirred tank reactor. In other embodiments, the reaction may be carried out continuously in one continuously stirred tank reactor or in a series of at least two continuously-stirred tank reactors.

The catalyst/dual promoter preferably is a mixture of $BF_3$ and $BF_3$ promoted with a mixture of a normal alcohol and an acetate ester.

In embodiments, a product of the process of the invention may be characterized as a 4 cSt (100° C.) PAO having a pour point of less than −60° C.

In embodiments, a product of the process of the invention may be characterized as a 6 cSt (100° C.) PAO having a pour point of less than −50° C.

These and other objects, features, and advantages will become apparent as reference is made to the following detailed description, preferred embodiments, examples, and appended claims.

DETAILED DESCRIPTION

According to the invention, in a preferred embodiment, a mixture of alphaolefins comprising 1-hexene, 1-decene, 1-dodecene, and 1-tetradecene is oligomerized in the presence of an alphaolefin oligomerization catalyst and a dual promoter comprising an alcohol and an ester promoter, to provide a product characterized by a viscosity at 100° C. of from about 4 to about 12 cSt.

In embodiments, the reaction may be carried out in a semi-batch mode or continuous mode in a single stirred tank reactor. In other embodiments, the reaction may be carried out continuously in a series of at least two continuously-stirred tank reactors.

The catalyst/dual promoter preferably is a mixture of $BF_3$ and $BF_3$ promoted with a mixture of a normal alcohol and an acetate ester.

In a preferred embodiment, the reaction is carried out in a series of at least two continuously stirred tank reactors. Residence time, temperature, and pressure in each reactor may be determined by one of ordinary skill in the art, but as a rule of guidance the residence times may range from about 0.1 to about 4 hours, more typically about 0.75 to about 2.5 hours, the temperature will be about 22° C.±5° C., and pressure will be about 7 psig±5 psig. The residence time in the first reactor may be shorter than, the same as, or longer than the residence time in the second reactor. It is preferred that the product be taken off from the final reactor when the reaction mixture has reached steady state, which may be determined by one of ordinary skill in the art. The reaction mixture from the final reactor is distilled to remove the unreacted monomers, promoters, and dimers, all of which may be recovered and reused in preferred embodiments. The bottoms product is then hydrogenated to saturate oligomers. The final product may then be distilled from the hydrogenated bottoms to produce, in embodiments, different grades of low viscosity PAO, which may also be mixed with the bottoms product after distillation to yield yet additional products.

In an embodiment, the product is a narrow cut (narrow molecular weight), low viscosity PAO. As used herein, the term "narrow cut" means narrow molecular weight range. The meaning of the term "narrow molecular weight range" may be understood by one of ordinary skill in the art in view of the foregoing.

The feed (to the first reactor in the case of multiple reactors or to the single reactor in the case of semi-batch mode) comprises a mixture of 1-hexene, 1-decene, 1-dodecene, and 1-tetradecene. Mixtures in all proportions may be used, e.g., from about 1 wt % to about 90 wt % 1-hexene, from about 1 wt % to about 90 wt % 1-decene, from about 1 wt % to about 90 wt % 1-dodecene, and from about 1 wt % to about 90 wt % tetradecene. In preferred embodiments, 1-hexene is present in the amount of about 1 wt % or 2 wt % or 3 wt % or 4 wt % or 5 wt % to about 10 wt % or 20 wt %, 1-decene is present in the amount of about 25 wt % or 30 wt %, or 40 wt %, or 50 wt % to about 60 wt % or 70 wt % or 75 wt %, 1-dodecene is present in the amount of about 10 wt % or 20 wt % or 25 wt % or 30 wt % or 40 wt % to about 45 wt % or 50 wt % or 60 wt %, and 1-tetradecene is present in the amount of 1 wt % or 2 wt % or 3 wt % or 4 wt % or 5 wt % or 10 wt % or 15 wt % or 20 wt % or 25 wt % to about 30 wt % or 40 wt % or 50 wt %. Ranges from any lower limit to any higher limit just disclosed are contemplated, e.g., from about 3 wt % to about 10 wt % 1-hexene or from about 2 wt % to about 20 wt % 1-hexene, from about 25 wt % to about 70 wt % 1-decene or from about 40 wt % to about 70 wt % 1-decene, from about 10 wt % to about 45 wt % 1-dodecene or from about 25 wt % to about 50 wt % 1-dodecene, and from about 5 wt % to about 30 wt % 1-tetradecene or from about 15 wt % to about 50 wt % 1-tetradecene. Numerous other ranges are contemplated, such as ranges plus or minus 5° C. (±5° C.) from those specified in the examples.

While minor proportions of other linear alphaolefins (LAO) may be present, such as 1-octene, in preferred embodiments the feed (or mixture of alphaolefins contacting the oligomerization catalyst and promoters) consists essentially of 1-hexene, 1-decene, 1-dodecene, 1-tetradecene, wherein the phrase "consists essentially of" (or "consisting essentially of" and the like) takes its ordinary meaning, so that no other LAO is present (or for that matter nothing else is present) that would affect the basic and novel features of the present invention. In yet another preferred embodiment the feed (or mixture of alphaolefins) consists of 1-hexene, 1-decene, 1-dodecene, 1-tetradecene, meaning that no other olefin is present (allowing for inevitable impurites).

In another preferred embodiment the olefin feed consists essentially of 1-decene, in yet another preferred embodiment the olefin feed consists essentially of 1-decene and 1-dodecene, in still another preferred embodiment the olefin feed consists essentially of 1-dodecene and 1-tetradecene, and in yet still another preferred embodiment the feed consists essentially of 1-dodecene.

In an embodiment, the olefins used in the feed are co-fed into the reactor. In another embodiment, the olefins are fed separately into the reactor. In either case, the catalyst/promoters may also be feed separately or together, with respect to each other and with respect to the LAO species.

In addition to the presence of a conventional $BF_3$ oligomerization catalyst, at least two different promoters (or cocatalysts) are also present. According to the present invention, the two different promoters are selected from (i) alcohols and (ii) esters, with at least one alcohol and at least one ester present.

Alcohols useful in the process of the invention are selected from C1-C10 alcohols, more preferably $C_1$-$C_6$ alcohols. They may be straight-chain or branched alcohols. Preferred alcohols are methanol, ethanol, n-propanol, n-butanol, n-pentanol, n-hexanol, and mixtures thereof.

Esters useful in the process of the invention are selected from the reaction product(s) of at least one alcohol and one acid. The alcohols useful to make esters according to the invention are preferably selected from the same alcohols set forth above, although the alcohol used to make the ester for the promoter used in (ii) may be different than the alcohol used as promoter in (i), or it may be the same alcohol. The acid is preferably acetic acid, although it may be any low molecular weight mono-basic carboxylic acid, such as formic acid, propionic acid, and the like.

It will be recognized by one of ordinary skill in the art that in the case where the alcohol in (i) is different than the alcohol used in (ii) that there may be some dissociation of the ester in (ii) so that it may be difficult to say exactly what the species of alcohol(s) and ester(s) are with precision. Furthermore, (i) and/or (ii) may be added separately from each other or added together, and separately or together with one or more of the olefin feed(s). It is preferred that $BF_3$ and acid/ester be added in the feed together with the one or more alphaolefin.

Accordingly, the disclosure should be read as in the nature of a recipe.

In this process, it is preferred that the ratio of the group (i) cocatalysts to group (ii) cocatalysts (i.e., (i): (ii)) range from about 0.2:1 to 15:1, with 0.5:1 to 7:1 being preferred.

As to the boron trifluoride, it is preferred that it be introduced into the reactor simultaneously with cocatalysts and olefin feed. In the case of more than one continuously stirred reactor connected in series, it is preferred that BF3, cocatalyst and olefin feed be introduced only to the first reactor, and preferably simultaneously. It is further preferred that the reaction zone(s) contain an excess of boron trifluoride, which is governed by the pressure and partial pressure of the boron trifluoride. In this regard, it is preferred that the boron trifluoride be maintained in the reaction zone at a pressure of about 2 to about 500 psig, preferably about 2 to 50 psig (1 psi=703 $kg/m^2$). Alternatively, the boron trifluoride can be sparged into the reaction mixture, along with other known methods for introducing the boron trifluoride to the reaction zone.

Suitable temperatures for the reaction may be considered conventional and can vary from about −20° C. to about 90° C., with a range of about 15° to 70° C. being preferred. Appropriate residence times in each reactor, and other further details of processing, are within the skill of the ordinary artisan in possession of the present disclosure.

In an embodiment, after steady-state conditions are achieved in the final reactor, product from the final or last reactor is sent to a first distillation column, wherein the unreacted monomers, dimers and promoters are distilled off. In an alternative the dimers may be taken off in a second distillation column. The bottoms product is then hydrogenated to saturate trimers and higher order oligomers. This hydrogenated product is then sent to another distillation column where distillation yields an overhead product having nominal viscosity of 4 cSt (100° C.) and a bottoms product having a nominal viscosity of 6 cSt (100° C.). The term "nominal" as used herein means the number determined experimentally is rounded to a single significant figure. A bottom product with a viscosity of up to about 12 cSt can be produced in the third column by polymerizing a heavier product in the reactors and/or by distilling more deeply in the third distillation column (e.g., using higher vacuum and/or higher temperature).

As is known from previous work, as reported in the aforementioned U.S. patent application Ser. No. 11/338,231, viscosity of the final product can be controlled by the ratio of alcohol to ester, with a higher viscosity achieved by having a higher alcohol:ester ratio. The degree of polymerization may also be attenuated more finely by controlling the concentration of the alcohol and the ester. This is, again, within the skill of the ordinary artisan in possession of the present disclosure.

The following examples are meant to illustrate embodiments of the present invention, and it will be recognized by one of ordinary skill in the art in possession of the present disclosure that numerous modifications and variations are possible. Therefore, it is to be understood that within the scope of the appended claims, the invention may be practiced otherwise than as specifically described herein.

The mixture of LAOs is polymerized either by semi-batch or continuous mode in a single stirred tank reactor or by continuous mode in a series of stirred tank reactors using BF3 and BF3 promoted with a mixture of normal alcohol and acetate. The reaction mixture is distilled to remove the unreacted monomers and dimers. The resulting product is hydrogenated to saturate the oligomers. The hydrogenated product is a low viscosity PAO. Depending on its viscosity, it can be further distilled and/or blended to produce different grades of low viscosity PAO.

The following examples illustrate the change in the low temperature properties of the low viscosity product with the change in the composition of the olefin feed mixture.

EXAMPLE 1

1-C10 and 1-C12 mixture containing 55 wt. % 1-C10 and 45 wt. % 1-C12 was oligomerized in two continuous stirred-tank reactors in series at 22° C. and 5 psig using BF3 and BF3 promoted butanol-butyl acetate mixture. The mole ratio of butanol to butyl acetate was 3 to 1. Residence times in the primary and secondary reactors were 1.4 hrs and 0.85 hr, respectively. A sample was taken from the second reactor when steady-state condition was attained. The sample was distilled to remove the unreacted monomers and the dimers.

The bottoms stream was hydrogenated to saturate the trimer+ oligomers. The hydrogenated product had a nominal viscosity at 100° C. of 5 cSt. A sample of the hydrogenated product was distilled to obtain a bottoms product with a nominal 100° C. viscosity of 6 cSt. The overheads product was blended with some of the 5 cSt PAO to make a product with a nominal 100° C. viscosity of 4 cSt. The properties of the product with a nominal 100° C. viscosity of 4 cSt are in Table 1 and those of the co-product with a nominal 100° C. viscosity of 6 cSt PAO are in Table 2. With the addition of C12 in the feed, the viscosity at −40° C. and the viscosity index (VI) of the 4 cSt and 6 cSt products improved and are better than those of the current commercial products (Reference A for 4 cSt in Table 1 and References B and C for 6 cSt in Table 2). The pour points of both products increased but they are acceptable.

EXAMPLE 2

Similar to Example 1 except that olefin feed mix had 50 wt. % 1-C6 and 50 wt. % 1-C14, the mole ratio of butanol to butyl acetate in the promoter system was 3.5 to 1 and the temperature was at 24° C. As shown in Tables 1 and 2, both the 4 cSt and 6 cSt products from this olefin feed mix have low temperature properties that are much higher than the corresponding references.

EXAMPLE 3

Similar to Example 1 except that the olefin feed mix had 10 wt. % 1-C8, 60 wt. % 1-C10 and 30 wt. % 1-C12, the residence time in the secondary reactor was 1 hr and the polymerization temperature was 24° C. The 4 cSt PAO properties shown in Table 1 are better than those of the C10 based commercial product. The 6 cSt co-product properties shown in Table 2 are comparable to those of the commercial C8/C10/C12 based product (Reference C). The process for making the commercial product is different from the process used in this experiment.

EXAMPLE 4

Similar to Example 1 except that the olefin feed mix had 10 wt. % 1-C6, 60 wt. % 1-C10 and 30 wt. % 1-C12. The 4 cSt product properties are not as good as those in Example 3 but they are still acceptable. However, the −40° C. viscosity of the 6 cSt co-product is too high.

EXAMPLE 5

Similar to Example 1 except that the olefin feed mix had 5 wt. % 1-C6, 60 wt. % 1-C10, 30 wt. % 1-C12 and 5 wt. % 1-C14 and the polymerization temperature was at 20° C. Both the 4 cSt and 6 cSt products have good low temperature properties.

EXAMPLE 6

1-C10 and 1-C14 mixture containing 70 wt. % 1-C10 and 30 wt. % 1-C14 was oligomerized by semi-batch mode in a continuous stirred-tank reactor at 23° C. and 5 psig using BF3 and BF3 promoted butanol-butyl acetate mixture. The mole ratio of butanol to butyl acetate was 2.5 to 1. Add time and hold time were 4 hrs and 2 hrs, respectively. After the 2-hr hold time, the mixture from the reactor was neutralized with 5% caustic solution and washed with water. It was then distilled to remove the unreacted monomers and the dimers. The hydrogenated product had a nominal viscosity at 100° C. of 5 cSt. A sample of the hydrogenated product was distilled to obtain a bottoms product with a nominal 100° C. viscosity of 6 cSt. The overheads product is light 4 cSt PAO and the properties are shown in Table 1. The properties of the 6 cSt co-product are in Table 2. The pour point of the 4 cSt product is good. However, that of the 6 cSt product is quite high.

EXAMPLE 7

Similar to Example 6 except that olefin feed mix had 80 wt. % 1-C10 and 20 wt. % 1-C14. As shown in Tables 1 and 2, the pour points of the 4 and 6 cSt products improved with the increase of the concentration of 1-C10 in the feed mix.

EXAMPLE 8

Similar to Example 6 except that the olefin feed mix had 60 wt. % 1-C10, 20 wt. % 1-C12 and 20 wt. % 1-C14, the mole ratio of butanol to butyl acetate was 1.5 to 1, and the add time was 5 hrs. The hydrogenated product is a light 5 cSt PAO and the properties are shown in Table 2. Compared to the current commercial 5 cSt PAO (Reference D shown in Table 2), it has a better VI. However, its pour is slightly higher.

EXAMPLE 9

Similar to Example 8 except that olefin feed mix had 40 wt. % 1-C10, 40 wt. % 1-C12 and 20 wt. % 1-C14 and the mole ratio of butanol to butyl acetate in the promoter system was 3.5 to 1. The resulting hydrogenated product is 6 cst PAO shown in Table 2. The pour point is inferior to the current commercial products (References B and C), however, the −40° C. viscosity and VI are much better than the references.

TABLE 1

Properties of 4 cSt PAO

| Example | Feed Olefin | 100° C. Viscosity, cSt | −40° C. Viscosity, cSt | VI | Pour Point, ° C. |
|---|---|---|---|---|---|
| Reference A | $C_{10}$ | 4.10 | 2850 | 122 | <−60 |
| 1 | 55/45 $C_{10}/C_{12}$ | 4.10 | 2732 | 128 | −60 |
| 2 | 50/50 $C_6/C_{14}$ | 4.09 | 3745 | 117 | −42 |
| 3 | 10/60/30 $C_8/C_{10}/C_{12}$ | 4.10 | 2762 | 127 | <−60 |
| 4 | 10/60/30 $C_6/C_{10}/C_{12}$ | 4.10 | 2942 | 125 | −60 |
| 5 | 5/60/30/5 $C_6/C_{10}/C_{12}/C_{14}$ | 4.09 | 2740 | 128 | <−60 |
| 6 | 70/30 $C_{10}/C_{14}$ | 3.83 | 2276 | 126 | −51 |
| 7 | 80/20 $C_{10}/C_{14}$ | 3.67 | 2087 | 123 | −57 |

TABLE 2

Properties of 5 & 6 cSt PAO

| Example | Feed Olefin | 100° C. Viscosity, cSt | −40° C. Viscosity, cSt | VI | Pour Point, ° C. |
|---|---|---|---|---|---|
| Reference B | $C_{10}$ | 5.90 | 7906 | 138 | −59 |
| Reference C | 10/60/30 $C_8/C_{10}/C_{12}$ | 5.65; 5.86 | 6886; 7712 | 138; 138 | −57; −57 |
| 1 | 55/45 $C_{10}/C_{12}$ | 5.95 | 7460 | 142 | −54 |
| 2 | 50/50 $C_6/C_{14}$ | 5.85 | Solid | 134 | −36 |
| 3 | 10/60/30 $C_8/C_{10}/C_{12}$ | 5.94 | 7906 | 140 | −54 |
| 4 | 10/60/30 $C_6/C_{10}/C_{12}$ | 5.91 | 8388 | 138 | −54 |
| 5 | 5/60/30/5 $C_6/C_{10}/C_{12}/C_{14}$ | 5.93 | 7551 | 142 | −51 |
| 6 | 70/30 $C_{10}/C_{14}$ | 5.84 | 6922 | 142 | −39 |
| 7 | 80/20 $C_{10}/C_{14}$ | 5.70 | 6792 | 140 | −45 |
| 8 | 60/20/20 $C_{10}/C_{12}/C_{14}$ | 4.77 | 4104 | 137 | −51 |
| 9 | 40/40/20 $C_{10}/C_{12}/C_{14}$ | 5.63 | 6150 | 144 | −42 |
| Reference D | 50/50 C10/C12 | 5.10 | 5016 | 136 | −54 |

The benefits of the process using a feed comprising at least one alphaolefin selected from C8, C10, C12, C14, and C16 has been previously noted in U.S. patent application Ser. No. 11/338,231. What is very surprising is that a process according to the present invention, using a feed comprising 1-hexene, 1-decene, 1-dodecene, and 1-tetradecene, is that properties similar to those achieveable using solely 1-decene are possible.

Kinematic Viscosity (K.V.) as used herein are those determined according to ASTM D445 at the temperature indicated (e.g., 100° C. or −40° C.), unless otherwise specified. If no temperature is indicated, 100° C. is assumed, according to convention.

Viscosity Index (VI) was determined according to ASTM D-2270.

Noack volatility as used herein are those determined according to ASTM D5800 method, unless otherwise specified. However, Noack volatility reported for compositions according to the present invention are determined according to ASTM D5800 with the exception that the thermometer calibration is performed annually rather than biannually.

Pour point was determined according to ASTM D5950.

Oligomer distribution was determined by using the Hewlett Packard (HP) 5890 Series II Plus GC, equipped with flame ionization detector (FID) and capillary column.

The low viscosity PAOs made according to the present invention are useful by themselves as lubricants or functional fluids, or they may be mixed with various conventional additives. They may also be blended with other basestocks, such as API Groups I-III and V, or other conventional PAOs (API Group IV) and also other hydrocarbon fluids, e.g., isoparaffins, normal paraffins, and the like. It has surprisingly been found that PAOs according to the invention may advantageously blended with significant quantities of Group III basestocks into lubricant compositions that meet the property requirements of SAE Grade 0W multigrade engine oil formulations. Group III basestocks by themselves do not have the necessary viscometrics required for 0W30 and 0W40 engine oil formulations. Such formulations are described in commonly-assigned, copending U.S. application Ser. No. 11/338,456.

All patents and patent applications, test procedures (such as ASTM methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein.

The invention has been described above with reference to numerous embodiments and specific examples. Many variations will suggest themselves to those skilled in this art in light of the above detailed description. All such variations are within the full intended scope of the appended claims, but particularly preferred embodiments include: a process for the oligomerization of alphaolefins comprising: (a) contacting 1-tetradecene, optionally with one or more of the alphaolefins selected from 1-hexene, 1-decene, and 1-dodecene, and more preferably contacting a mixture of alphaolefins comprising 1-hexene, 1-decene, 1-dodecene, and 1-tetradecene, an alphaolefin oligomerization catalyst, an alcohol promoter, and an ester promoter in at least one continuously stirred reactor under oligomerization conditions for a time sufficient to achieve a steady state reaction mixture; (b) distilling off unreacted alphaolefin and dimers of said mixture to obtain a bottoms product comprising said trimer and heavier oligomers; (c) hydrogenating said bottoms product to obtain a hydrogenated bottoms product; and then (d) fractionating said hydrogenated bottoms product to obtain an overhead product and a bottoms product, different from said hydrogenated bottoms product, which may be more preferably characterized by embodiments: wherein said process occurs in at least two continuously stirred reactors connected in series; wherein said overhead product in step (d) has a nominal viscosity of 4 cSt (100° C.) (and still more preferably characterized by a pour point of less than −60° C.) and said bottoms product different from said hydrogenated bottoms product has a nominal viscosity of 6 cSt (100° C.) (and still more preferably characterized by a pour point of less than −50° C.); wherein step (d) further comprises obtaining a bottoms product with nominal viscosity of from 7 to 12 cSt; or various preferred embodiments concerning the feed or mixture of alphaolefins, such as wherein said mixture of alphaolefins comprises from about 1 wt % to about 90 wt % 1-hexene, from about 1 wt % to about 90 wt % 1-decene, from about 1 wt % to about 90 wt % 1-dodecene, and from about 1 wt % to about 90 wt % 1-tetradecene, or wherein said mixture of alphaolefins comprises from about 1 wt % to about 10 wt % 1-hexene, from about 50 wt % to about 70 wt % 1-decene, from about 20 wt % to about 40 wt % 1-dodecene, and from about 1 wt % to about 10 wt % 1-tetradecene, or wherein said mixture of alphaolefins comprises from about 1 wt % to about 10 wt % 1-hexene, from about 50 wt % to about 70 wt % 1-decene, from about 20 wt % to about 40 wt % 1-dodecene, and from about 1 wt % to about 10 wt % 1-tetradecene, or wherein said mixture of alphaolefins consists essentially of from about 1 wt % to about 10 wt % 1-hexene, from about 50 wt % to about 70 wt % 1-decene, from about 20 wt % to about 40 wt % 1-dodecene, and from about 1 wt % to about 10 wt % 1-tetradecene, or wherein said mixture of alpha olefins consists of from about 1 wt % to about 10 wt % 1-hexene, from about 50 wt % to about 70 wt % 1-decene, from about 20 wt % to about 40 wt % 1-dodecene, and from about 1 wt % to about 10 wt % 1-tetradecene, or wherein said mixture of alpha olefins consists of from about 2 wt % to about 20 wt % 1-hexene, from about 40 wt % to about 80 wt % 1-decene, from about 10 wt % to about 50 wt % 1-dodecene, and from about 2 wt % to about 20 wt % 1-tetradecene, or wherein said mixture of alpha olefins consists of from about 3 wt % to about 30 wt % 1-hexene, from about 40 wt % to about 65 wt % 1-decene, from about 10 wt % to about 50 wt % 1-dodecene, and from about 3 wt % to about 30 wt % 1-tetradecene; wherein said ester is an alkyl acetate ester, still more preferably wherein said ester is the ester reaction product of acetic acid and at least one alcohol selected from methanol, ethanol, n-propanol, n-butanol, n-pentanol, and n-hexanol; wherein said alcohol is selected from methanol, ethanol, n-propanol, n-butanol, n-pentanol, n-hexanol, and mixtures thereof; wherein said alcohol is selected from methanol, ethanol, n-propanol, n-butanol, n-pentanol, n-hexanol, and mixtures thereof, said ester is at least one alkyl acetate ester, and the ratio of alcohol to ester is in the range of from about 0.2:1 to about 15:1; wherein said alphaolefin oligomerization catalyst is boron trifluoride; or by the various methods described herein for adding the various ingredients, e.g., wherein said process is further characterized by cofeeding said boron trifluoride into a first reactor along with said alcohol and ester cocatalysts and said olefins. Clearly the ordinarily skill artisan in possession of the present disclosure would know that these various embodiments may be combined in numerous way. Other preferred embodiments of the invention include a composition comprising at least one PAO made by the process of Claim 1 or a composition comprising at least one PAO obtainable by the process of Claim 1, and especially a PAO made by the process of the invention and characterized by a nominal viscosity of 4 cSt (100° C.) and a pour point of less than −60° C. and/or a PAO made by the process of the invention and characterized by a nominal viscosity of 6 cSt (100° C.) and a pour point of less than −50° C.

Also a preferred embodiment is the use of any of the foregoing or combinations of the foregoing (as would be recognized by one of ordinary skill in the art in possession of this disclosure) in lubricant compositions and other functional fluids, such as hydraulic fluids, diluents, and the like.

What is claimed is:

1. A process for the oligomerization of linear alphaolefins comprising:

(a) contacting a mixture of linear alphaolefins consisting of about 1 to about 20 wt % 1-hexene, about 40 to about 80 wt % 1-decene, about 10 to about 50 wt % 1-dodecene, and about 1 to about 20 wt % 1-tetradecene, an alphaolefin oligomerization catalyst, an alcohol promoter, and an ester promoter in at least one continuously stirred reactor under oligomerization conditions for a time sufficient to achieve a steady state reaction mixture;

(b) distilling off unreacted alphaolefin and dimers of said mixture to obtain a bottoms product comprising said trimer and heavier oligomers;

(c) hydrogenating said bottoms product to obtain a hydrogenated bottoms product; and then (d) fractionating said hydrogenated bottoms product to obtain an overhead product and a bottoms product, different from said hydrogenated bottoms product, wherein the overhead product and the bottoms product both have a nominal viscosity at 100° C. of about 12 cSt or less.

2. The process according to claim 1, wherein said process occurs in at least two continuously stirred reactors connected in series.

3. The process according to claim 1, wherein said overhead product in step (d) has a nominal viscosity of 4 cSt (100° C.) and said bottoms product different from said hydrogenated bottoms product has a nominal viscosity of 6 cSt (100° C.).

4. The process according to claim 3, wherein said overhead product in step (d) is further characterized by a pour point of less than −60° C.

5. The process according to claim 3, wherein said bottoms product different from said hydrogenated bottoms product is further characterized by a pour point of less than −50° C.

6. The process according to claim 1, wherein step (d) further comprises obtaining a bottoms product with nominal viscosity of from 7 to 12 cSt.

7. The process according to claim 1, wherein said mixture of linear alpha olefins consists of from about 1 wt % to about 10 wt % 1-hexene, from about 50 wt % to about 70 wt % 1-decene, from about 20 wt % to about 40 wt % 1-dodecene, and from about 1 wt % to about 10 wt % 1-tetradecene.

8. The process according to claim 1, wherein said mixture of linear alpha olefins consists of from about 2 wt % to about 20 wt % 1-hexene, from about 40 wt % to about 80 wt % 1-decene, from about 10 wt % to about 50 wt % 1-dodecene, and from about 2 wt % to about 20 wt % 1-tetradecene.

9. The process according to claim 1, wherein said ester is an alkyl acetate ester.

10. The process according to claim 9, wherein said ester is the ester reaction product of acetic acid and at least one alcohol selected from the group consisting of methanol, ethanol, n-propanol, n-butanol, n-pentanol, and n-hexanol.

11. The process according to claim 1, wherein said alcohol is selected from the group consisting of methanol, ethanol, n-propanol, n-butanol, n-pentanol, n-hexanol, and mixtures thereof.

12. The process according to claim 1, wherein said alcohol is selected from the group consisting of methanol, ethanol, n-propanol, n-butanol, n-pentanol, n-hexanol, and mixtures thereof, said ester is at least one alkyl acetate ester, and the ratio of alcohol to ester is in the range of from about 0.2:1 to about 15:1.

13. The process according to claim 1, wherein said alphaolefin oligomerization catalyst is boron trifluoride.

14. The process according to claim 13, wherein said process is further characterized by cofeeding said boron trifluoride into a first reactor along with said alcohol and ester cocatalysts and said olefins.

* * * * *